US005960953A

United States Patent [19]

Gratz

[11] Patent Number: 5,960,953

[45] Date of Patent: Oct. 5, 1999

[54] TRAY FOR SUPPORTING A PLURALITY OF NAIL PACKS

[75] Inventor: Jeffrey J. Gratz, Hartland, Wis.

[73] Assignee: Fibreform Containers, Inc., Germantown, Wis.

[21] Appl. No.: 09/055,776

[22] Filed: Apr. 6, 1998

[51] Int. Cl.[6] ..... B65D 85/24; B65D 1/34

[52] U.S. Cl. ..... 206/338; 206/343; 206/564; 206/557

[58] Field of Search ..... 206/338, 343, 206/344, 345, 565, 557, 564, 815

[56] References Cited

U.S. PATENT DOCUMENTS

| | | | |
|---|---|---|---|
| 2,886,828 | 5/1959 | Lattuca | 206/557 |
| 2,941,663 | 6/1960 | Ettlinger, Jr. | 206/72 |
| 2,965,226 | 12/1960 | Ettlinger, Jr. | 206/72 |
| 3,369,659 | 2/1968 | Ettlinger, Jr. | 206/72 |
| 4,183,435 | 1/1980 | Thompson et al. | 206/557 |
| 4,275,854 | 6/1981 | Jureit et al. | 242/55 |
| 4,712,676 | 12/1987 | Randall | 206/338 |
| 4,722,440 | 2/1988 | Johnston | 206/319 |
| 4,896,774 | 1/1990 | Hammett et al. | 206/516 |
| 4,944,398 | 7/1990 | Gatt | 206/507 |
| 5,244,094 | 9/1993 | Graff, Jr. et al. | 206/593 |

FOREIGN PATENT DOCUMENTS

| | | | |
|---|---|---|---|
| 2032886 | 5/1980 | United Kingdom | 206/564 |
| 2035267 | 6/1980 | United Kingdom | 206/564 |

*Primary Examiner*—Paul T. Sewell
*Assistant Examiner*—J. Mohandesi
*Attorney, Agent, or Firm*—Jansson, Shupe, Bridge & Munger, LTD.

[57] ABSTRACT

A tray for supporting a plurality of nail packs is provided. The tray includes a generally rectangular planar tray body having a nail supporting surface and an outer periphery. A stiffening wall projects vertically from the outer periphery of the tray body and terminates at an upper end. A generally planar lip extends laterally from the upper end of the stiffening wall. A sensing structure extends vertically from the nail supporting surface of the tray body beyond the upper end of the stiffening wall.

15 Claims, 2 Drawing Sheets

TRAY FOR SUPPORTING A PLURALITY OF NAIL PACKS

BACKGROUND AND SUMMARY OF THE INVENTION

This invention relates to packaging, and in particular, to a tray for use in the packaging, transport and/or storage of nail packs.

In order to expedite the nailing process in construction, a nail gun is often used to replace the conventional hammer. A nail gun utilizes pneumatic or hydraulic pressure to drive a nail into a predetermined location. Since nail guns have the ability to perform this process very quickly, nails must be continuously fed into the nail gun.

Nail packs have been designed to facilitate the rapid feeding of nails into the nail gun. The nail pack consists of a plurality of nails interconnected linearly by one or more wires to form a "string" of nails. In order to transport the "string", the attached nails are rolled into a donut-shaped pack. These nail packs are then packaged for shipment and/or storage.

Heretofore, trays have been used to support the nail packs during transport and/or storage. Typically, these prior art nail trays are constructed from materials such as molded fiber, expanded polystyrene, or the like. However, it has been found that prior art trays for nail packs lack sufficient strength to support the nail packs during transport and storage.

Further, nail packs are typically deposited on the nail trays by a nail pack depositing mechanism as the nail trays are conveyed along a conveyor belt. It is highly desirable to increase the rate at which the nail packs are deposited on the tray. This, in turn, requires a simple and inexpensive means for detecting the position of a nail tray relative to the nail pack depositing mechanism.

Therefore, it is a primary object and feature of the present invention to provide a nail tray for the transport and/or storage of nail packs which is simple and inexpensive to manufacture.

It is a still object and feature of the present invention to provide a nail tray for the transport and/or storage of nail packs which provide sufficient support for the nail packs during transport and/or storage.

It is a still further object and feature of the present invention to provide a nail tray for the transport and/or storage of nail packs which incorporates a simple inexpensive mechanism for facilitating the depositing of the nail packs thereon.

Various other features, objects and advantages of the invention will be made apparent from the following description taken together with the drawings.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings.

DETAILED DESCRIPTION OF THE INVENTION

Figure 1:
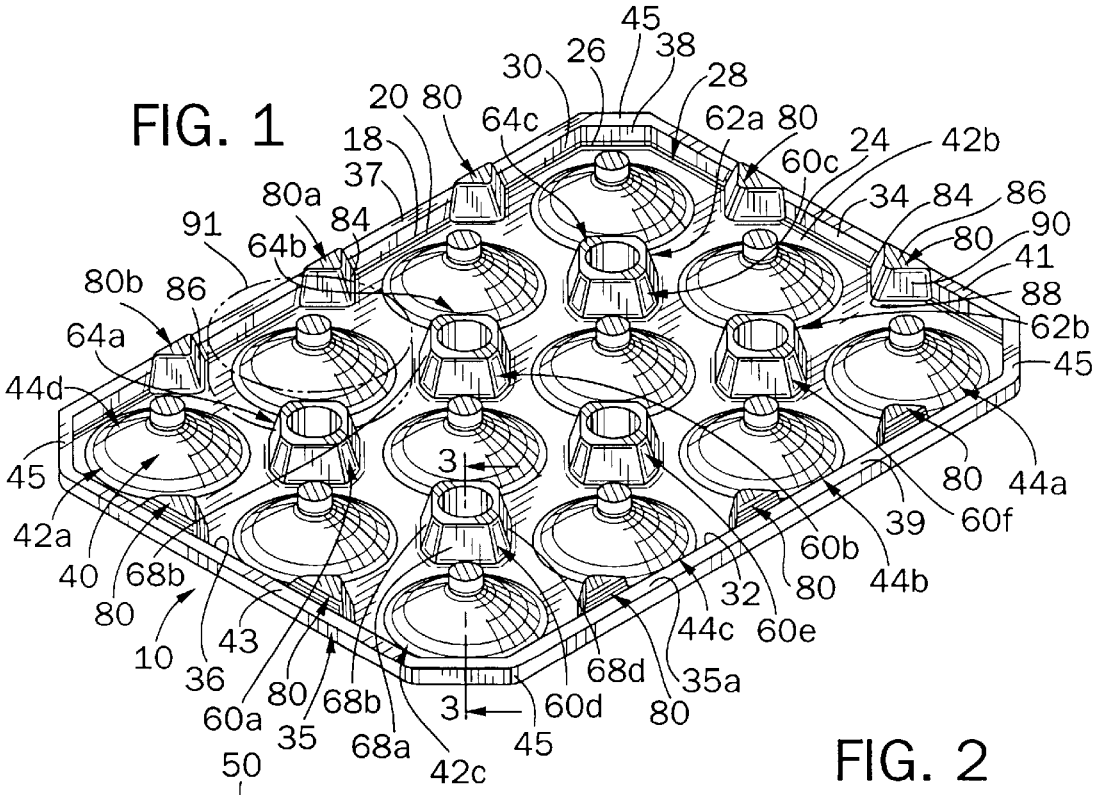
FIG. 1 is an isometric view of a nail tray in accordance with the present invention.
Figure 2:
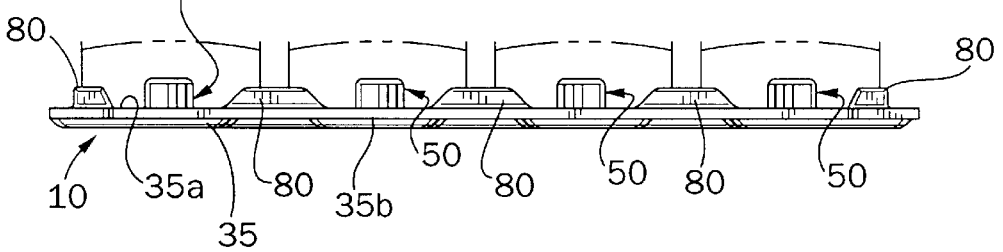
FIG. 2 is a side elevational view of the nail tray of FIG. 1.

Referring to FIG. 1, a nail tray in accordance with the present invention is generally designated by the reference numeral 10. It is contemplated that nail tray 10 be formed from a molded fibrous or plastic material. However, it is contemplated that the nail tray of the present invention be formed from other materials such as paper, corrugated, sheet metal or the like.

Nail tray 10 includes a generally planar support member 12 having an upwardly facing surface 14 and an opposite, downwardly facing surface 16. As best seen in FIGS. 1 and 5*a*–7*b*, nail tray 10 is generally rectangular in shape. However, it is contemplated that nail tray 10 be formed of any configuration.

Nail tray 10 includes an outer periphery 18 defined by first and second parallel side edges 20 and 22, respectively, and first and second ends 24 and (not shown) perpendicular to side edges 20 and 22. Each side edge 20 and 22 is interconnected to a corresponding end 24 and (not shown) by a chamfered corner 26. Each chamfered corner 26 facilitates the insertion of nail tray 10 into a packaging container such as a corrugated box or the like by removing a portion of the nail tray 10, i.e. the corner, which may hang up against the interior surface of the packaging container upon insertion of the nail tray 10 therein.

A stiffening wall 28 projects vertically from the outer periphery 18 of nail tray 10. Stiffening wall 28 includes first and second parallel side portions 30 and 32 and first and second end portions 34 and 36, respectively, transverse to side portions 30 and 32. Corner portions 38 of stiffening wall 28 project vertically from each chamfered corner 26 and interconnect ends of side portions 30 and 32 with corresponding ends of end portions 34 and 36.

A horizontal, generally planar lip 35 extends laterally from the upper end of stiffening wall 28. Planar lip 35 includes side portions 37 and 39 which extend laterally from the upper end of corresponding side portions 30 and 32, respectively, of stiffening wall 28. Similarly, end portions 41 and 43 of planar lip 35 extend from the upper end of corresponding end portions 34 and 36, respectively, of stiffening wall 28. Corner portions 45 of planar lip 35 extend horizontally from corresponding corner portions 38 of stiffening wall 28 and interconnect side portions 37 and 39 of planar lip 35 to corresponding end portions 41 and 43 of planar lip 35.

Planar lip 35 is defined by a generally planar upper surface 35*a,* and an opposite, downwardly facing surface 35*b.* Upper surface 35*a* and downwardly facing surface 35*b* of planar lip 35 are interconnected by a generally vertical, outer edge 35*c.* Planer lip 35 and stiffening wall 28 provide strength and rigidity to nail tray 10.

Nail tray 10 further includes a plurality of nail pack retaining projections 40 integrally molded with and disposed in uniformly spaced relation over the nail tray 10. As shown in the drawings, nail pack retaining projections 40 are arranged in a plurality of rows 42*a–c* and a plurality of columns 44*a–d.* However, it is contemplated as being within the scope of the present invention to arrange retaining projections 40 in various configurations over nail tray 10, and it is further contemplated that the number of rows and columns of retaining projections 40 disposed on nail tray 10 be varied to a desired number.

Figure 3:
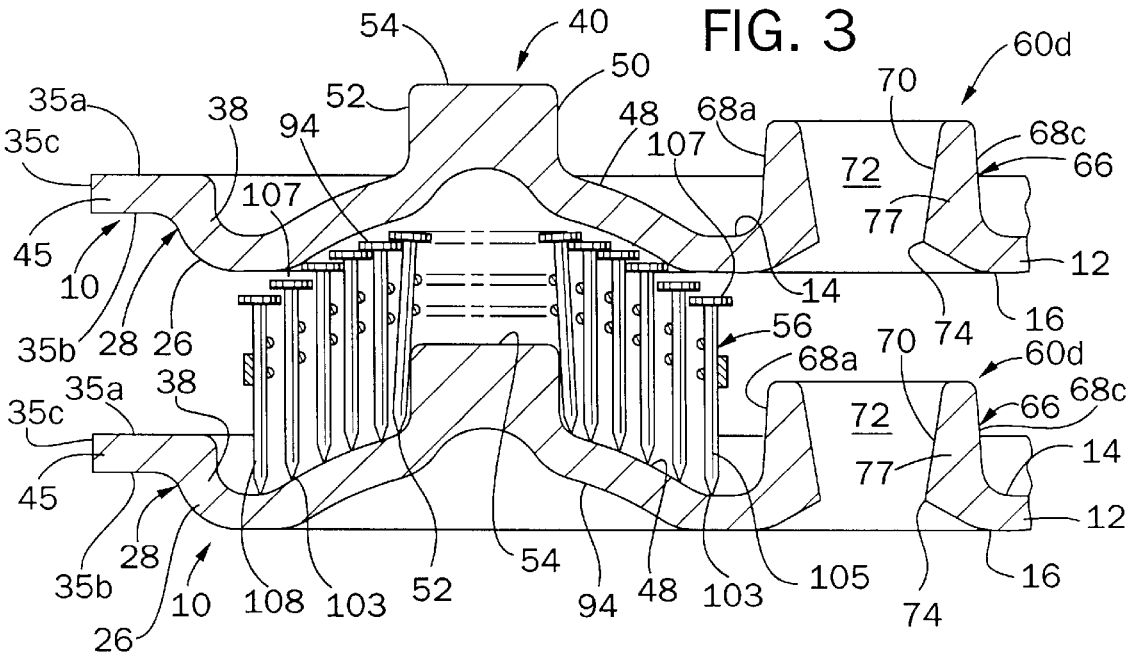
FIG. 3 is an enlarged, cross-sectional view taken along line 3—3 of FIG. 1 showing a portion of a stack of trays holding a nail pack therebetween.

As best seen in FIG. 3, each nail pack retaining projection 40 is generally convex in shape and includes an upper nail engaging surface 48 which projects from the upwardly facing surface 14 of nail tray 10. A generally cylindrical retaining element 50 projects vertically from the apex of nail engaging surface 48.

Nail retaining element 50 is defined by a generally cylindrical outer wall 52 which extends vertically from nail engaging surface 48. A nail retaining element 50 further includes a horizontal, upper surface 54 which is perpendicular to outer wall 52 of nail retaining element 50. The diameter of nail retaining element 50 is generally equal to the diameter of opening 55 formed in the center of nail pack 56, FIG. 3.

Nail tray 10 further includes a plurality of finger hole structures 60*a–f* arranged in rows 62*a* and 62*b* and columns 64*a–c.* Each finger hole structure 60*a–f* is generally tubular and includes an outer surface 66 having a generally rectangular cross section. Outer surface 66 of each finger hole structure 60*a–f* is defined by generally vertical side wall portions 68*a–d.* Side wall portion 68*a* and 68*c* of each finger hole structure 60*a–f* are generally planer and lie in parallel planes. Similarly, side wall portions 68*b* and 68*d* of each finger hole structure 60*a–f* are planer and lie in parallel planes. Side wall portions 68*a* and 68*c* are perpendicular to side wall portions 68*b* and 68*d* of each finger hole structure 60*a–f.*

Each finger hole structure 60*a–f* further includes an inner surface 70 which defines a generally conical passageway 72 which terminates at a generally circular opening 74 in the bottom surface 16 of nail tray 10. Inner surface 70 is spaced from outer surface 66 so as to define rigid wall 77 therebetween. In operation, a user may extend one or more fingers through passageway 72 in a corresponding finger structure 60*a–f* so as to allow the user to grasp a corresponding nail tray 10 therewith. Rigid wall 77 provides sufficient strength and stability so as to allow a user to lift nail tray 10 by finger holes structures 60*a–f* above a supporting surface.

Nail tray 10 further includes a plurality of sensor structures 80 spaced about the outer periphery of nail tray 10. Each sensor structure 80 includes first and second vertical walls 84 and 86, respectively extending from the upper surface 14 of nail tray 10. Vertical walls 84 and 86 are perpendicular to each other and diverge from a corner 88. Each vertical wall 84 and 86 lies in a plane parallel to either side wall portions 68*a* and 68*c* or side wall portions 68*b* and 68*d* of each finger hole structure 60*a–f.*

Each sensor structure 80 further includes a third wall 90 which extends vertically from the outer periphery 18 of nail tray 10 and between vertical walls 84 and 86 of sensor structure 80. Vertical walls 84, 86 and 90 are interconnected by a horizontal upper wall 92.

Each nail pack retaining projection 40 partially defines a pocket for receiving a nail pack. By way of example, a pocket 91 is shown in phantom in FIG. 1. Pocket 91 is defined by vertical walls 84 and 86 of corresponding sensor structures 80*a* and 80*b,* as well as by side wall portions 68*c* and 68*a* of finger hole structures 60*a* and 60*b,* respectively. Vertical walls 84 and 86 of sensor structures 80*a* and 80*b,* respectively, and side wall portions 68*b* and 68*c* of finger hole structures 60*b* and 60*a,* respectively, prevent the lateral movement of a nail pack 56 within pocket 91 on nail tray 10.

In order to facilitate the stacking of nail trays 10 on each other, a plurality of concave depressions 94 are formed in the downwardly facing surface 16 of nail tray 10. Each concave depression 94 is formed on nail tray 10 opposite convex surface 48 of each nail pack retaining member 40, and is dimensioned to receive an upper portion of corresponding nail pack 56 therein, FIG. 3.

In order to place nail packs 56 on nail trays 10, nail tray 10 is positioned on a conveyor 100. By way of example, conveyor 100 moves from left to right in FIGS. 4*a–*4*b.* A nail pack deposit assembly is provided and includes a signal generator 102 and a receiver 104 positioned on opposite sides 106 and 108, respectively, of conveyor 100. Signal generator 102 and receiver 104 are in axial alignment at a level between the upper surface of stiffening wall 28 and horizontal upper wall 92 of each sensor structure 80.

Figure 4A:
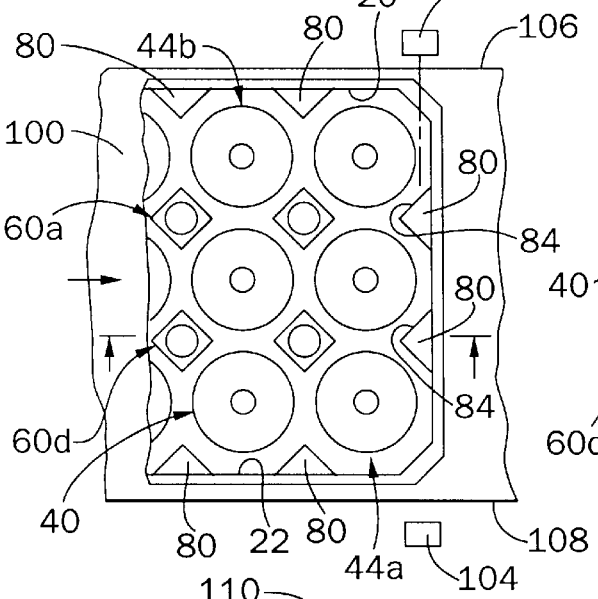
FIG. 4*a* is a top plan view of the nail tray of the present invention in a first position prior to the depositing of nail packs onto the nail tray.

Nail pack depositing assembly further includes a nail pack depositing structure 110 which deposits nail packs 56 on corresponding nail pack retaining members 40 in response to a signal from receiver 104. In operation, signal generator 102 transmits a signal therefrom which is received by receiver 104. A nail tray 10 is placed on conveyor 100. As conveyor 100 moves from left to right in FIG. 4*a,* nail tray 10 positioned on conveyor 100 travels therewith. As best seen in FIG. 4*a,* the signal generated by signal generator 102 engages vertical wall 84 of sensor structure 80 so as to prevent receiver 104 from receiving the signal and to initialize the depositing of nail packs 56 on nail tray 10.

Figure 5A:
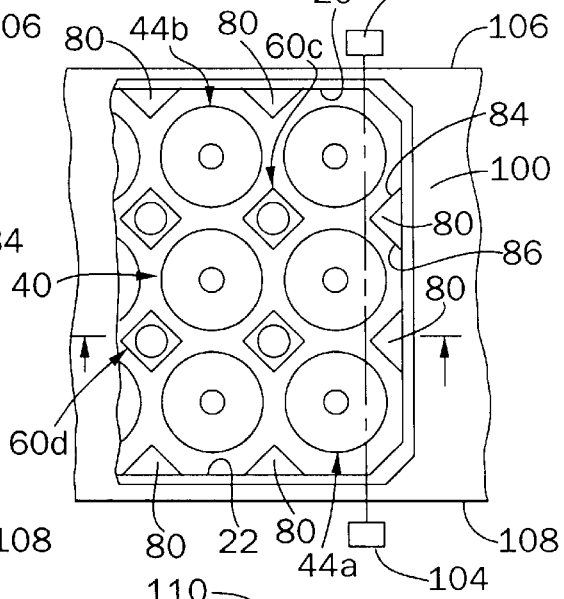
FIG. 5*a* is a top plan view of the nail tray of the present invention in a second, nail pack depositing position.
Figure 4B:
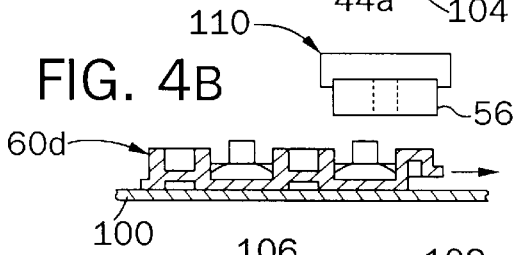
FIG. 4*b* is a cross-sectional view of FIG. 4*a* showing the nail tray of the present invention in the first position.
Figure 5B:
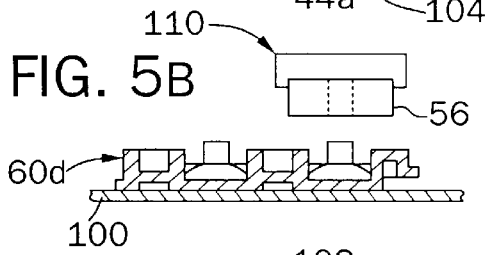
FIG. 5*b* is a cross-sectional view of FIG. 5*a* showing the nail tray of the present invention in the second position.

As nail tray 10 continues along conveyor 100, the signal generated by signal generator 102 is received by receiver 104, FIG. 5*a.* Upon receiving signal from signal generator 102, receiver 104 instructs nail pack depositing structure 110 to deposit a nail pack 56 on each nail pack retaining member 40 in column 44*a* of nail tray 10, FIG. 5*b.* Each nail pack 56 is deposited on a corresponding nail pack retaining member 40 such that nail retaining element 50 is received within a corresponding opening 55 formed in the center of nail pack 56, and such that the tips 103 of each nail 105 of nail pack 56 engage the upper nail engaging surface 48 on the upwardly facing surface 14 of support member 12.

Figure 6A:
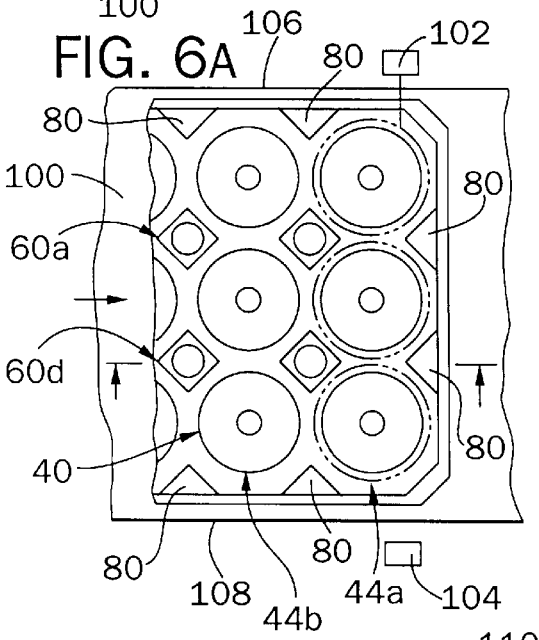
FIG. 6*a* is a top plan view showing the nail tray of the present invention in the second position after a first row of nail packs have been deposited thereon.
Figure 7A:
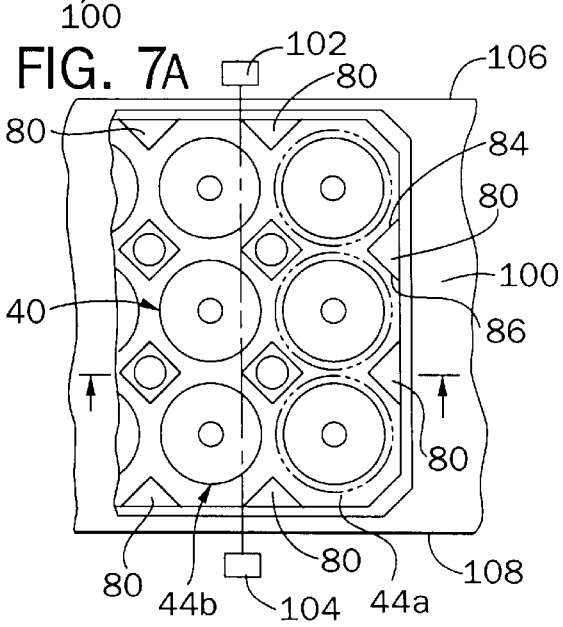
FIG. 7*a* is a top plan view showing the nail tray of the present invention in a third position prior to depositing a second row of nail packs thereon.
Figure 6B:
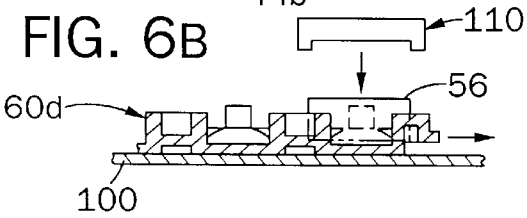
FIG. 6*b* is a cross-sectional view of FIG. 6*a* showing the nail tray of the present invention in the second position after a first row of nail packs have been deposited thereon.
Figure 7B:
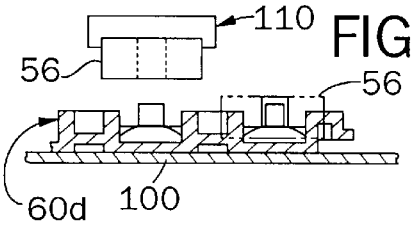
FIG. 7*b* is a cross-sectional view of FIG. 7*a* showing the nail tray of the present invention in the third position.

With nail packs 56 deposited on each nail pack retaining member 40 in column 44*a* of nail tray 10, receiver 104 is blocked from receiving the signal generated by signal generator 102, FIG. 6*a.* As a result, receiver 104 instructs conveyor 100 to conveying nail tray 10, from left to right in FIG. 6*b,* until such time that receiver 104 once again receives the signal from signal generator 102, FIG. 7*a.* Receiver 104 receives the signal from signal generator 102, nail pack depositing structure 110 is in alignment with and overlaps corresponding nail pack retaining members 40 in a column 44*b* of nail tray 10, FIG. 7*b.* Upon receiving the signal from signal generator 102, receiver 104 instructs nail pack depositing structure 110 to deposit a nail pack 56 on each hail pack retaining member 40 in column 44*b* of nail tray 10, as heretofore described. The process is continued until such time as a nail pack 56 is deposited on each nail pack retaining member 40 of nail tray 10.

It is contemplated that a plurality of nail trays 10 may be positioned on conveyor 100 in order to deposit nail packs 56 on each of the nail trays 10. Thereafter, the nail trays 10 may be stacked upon each other, FIG. 3, in order for storage or shipment. With nail trays 10 stacked upon each other, FIG. 3, the heads 107 of each nail 105 of nail pack 56 are receivable within a corresponding concave depression 94 in downwardly facing surface 16 of support member 12.

Various modes of carrying out the invention are contemplated as being within the scope of the following claims particularly pointing out and distinctly claiming the subject matter which is regarded as the invention.

I claim:

1. A tray for supporting a plurality of nail packs, comprising:

a generally planar tray body having an upwardly facing, nail supporting surface and an outer periphery;

a convex nail pack supporting structure projecting from the nail supporting surface of the tray body, the nail pack supporting structure terminating in an apex;

a generally cylindrical head extending vertically from the apex of the nail pack supporting structure;

a stiffening wall projecting vertically from the outer periphery of the tray body and terminating at an upper end; and a generally planar lip extending laterally from the upper end of the stiffening wall.

2. The tray of claim 1 further comprising a pocket definition structure extending vertically from the nail supporting surface of the tray body beyond the upper end of the stiffening wall.

3. The tray of claim 2 wherein the pocket definition structure is positioned adjacent the outer periphery of the tray body.

4. The tray of claim 1 further comprising a grasping structure projecting vertically from the nail supporting surface of the tray body, the grasping structure defining a passageway therethrough.

5. The tray of claim 4 wherein the passageway in the grasping structure extends along an axis perpendicular to the nail supporting surface of the tray body.

6. The tray of claim 4 wherein the passageway of the grasping structure is generally conical in shape.

7. The tray of claim 1 further comprising a retaining structure for preventing lateral movement of a nail pack supported on the nail supporting surface of the tray body.

8. The tray of claim 1 wherein the tray body includes a downwardly facing surface having a concave depression therein, the concave depression forcing a convex nail pack supporting structure on the nail supporting surface of the tray body.

9. The tray of claim 1 further comprising a plurality of pockets formed on the nail supporting surface of the tray body, each pocket dimensioned for receipt of a corresponding nail pack therein.

10. The tray of claim 9 wherein the pockets on the nail supporting surface of the tray body are arranged to define a plurality of rows and columns.

11. A tray for supporting a plurality of nail packs, comprising:

a generally rectangular planar tray body having a nail supporting surface and an outer periphery;

a stiffening wall projecting vertically from the outer periphery of the tray body and terminating at an upper end; and a plurality of pockets formed in the nail supporting surface of the tray body wherein one or more pockets are partially defined by the stiffening wall, and wherein each pocket is partially defined by a convex nail pack supporting structure projecting from the supporting surface of the tray body, the nail pack supporting structure terminating in an apex;

a generally cylindrical head extending vertically from the apex of the nail pack supporting structure;

a pocket definition structure extending vertically from the nail supporting surface of the tray body beyond the upper end of the stiffening wall.

12. The tray of claim 11 further comprising a generally tubular grasping element projecting vertically from the nail supporting surface of the tray body, the grasping element defining a passageway therethrough.

13. The tray of claim 12 wherein each pocket is partially defined by the grasping element.

14. The tray of claim 11 further comprising a retaining structure extending from the tray body for preventing lateral movement of a nail pack supported on the supporting surface of the tray body.

15. The tray of claim 11 wherein the tray body is partially defined by a chamfered corner interconnecting a side and an end of the tray body.

* * * * *

UNITED STATES PATENT AND TRADEMARK OFFICE

CERTIFICATE OF CORRECTION

PATENT NO. : 5,960,953

DATED : October 5, 1999

INVENTOR(S) : Jeffery J. Gratz

It is certified that error appears in the above-identified patent and that said Letters Patent is hereby corrected as shown below:

At column 5, line 1, change "hail", to --nail--.
At column 6 line 6, change "forcing" to --forming--.

Signed and Sealed this

Twenty-seventh Day of June, 2000

*Attest:*

Q. TODD DICKINSON

*Attesting Officer*

*Director of Patents and Trademarks*